United States Patent [19]

Gary

[11] Patent Number: 4,862,864

[45] Date of Patent: Sep. 5, 1989

[54] FINISH FOR CYLINDER LINERS

[75] Inventor: Joseph V. Gary, Chagrin Falls, Ohio

[73] Assignee: Chromium Corporation, Richardson, Tex.

[21] Appl. No.: 111,432

[22] Filed: Oct. 20, 1987

Related U.S. Application Data

[62] Division of Ser. No. 22,585, Mar. 10, 1987, Pat. No. 4,706,417.

[51] Int. Cl.[4] ..... F02B 75/08

[52] U.S. Cl. ..... 123/668

[58] Field of Search ..... 123/193 C, 668, 669; 51/319, 290, 411

[56] References Cited

U.S. PATENT DOCUMENTS

| | | | |
|---|---|---|---|
| 2,313,442 | 3/1943 | Kline | 51/290 |
| 2,314,604 | 3/1943 | Horst . | |
| 2,412,698 | 12/1946 | Horst . | |
| 2,430,750 | 11/1947 | Webersinn . | |
| 2,433,457 | 12/1947 | Jarrett . | |
| 2,434,880 | 1/1948 | Bramberry | 51/290 |
| 2,450,296 | 9/1948 | Passalacqua . | |
| 2,577,818 | 12/1951 | Shaw | 51/290 |
| 2,620,296 | 12/1952 | Wilsdon . | |
| 3,063,763 | 11/1962 | Zubrisky . | |
| 3,749,072 | 7/1973 | Schwelkher | 123/193 C |
| 3,808,955 | 5/1974 | Hamada | 123/193 C |
| 3,961,104 | 6/1976 | Tanner | 51/290 |
| 4,065,365 | 12/1977 | Ibarguengoitia | 51/323 |
| 4,196,547 | 4/1980 | Keske | 51/204 |
| 4,221,639 | 9/1980 | Ninagawa et al. | 123/193 C |
| 4,528,950 | 7/1985 | Oblander et al. | 123/193 C |

FOREIGN PATENT DOCUMENTS

| | | | |
|---|---|---|---|
| 2050882 | 1/1981 | United Kingdom | 51/319 |

*Primary Examiner*—David A. Okonsky

*Attorney, Agent, or Firm*—Brumbaugh Graves Donohue & Raymond

[57] ABSTRACT

A finish for a cylinder liner is provided by first treating the entire inner surface area of the cylinder liner to form a base porosity. An abrasive media is then applied only to portions of the inner surface area to create an extremely light break-in surface, preferably in a pattern such that at any axial location of a piston ring in the cylinder, its periphery is in contact with both the areas of the break-in surface as well as the areas of base porosity to which the break-in surface has not been applied.

15 Claims, 1 Drawing Sheet

FINISH FOR CYLINDER LINERS

This application is a division of application Ser. No.022,585, filed on Mar. 10, 1987 and now U.S. Pat. No.4,706,417.

BACKGROUND OF THE INVENTION

The present invention relates to the finish for a cylinder liner, and in particular to chromium plated internal combustion engine cylinder liners, and to a method of applying this finish.

In the manufacture of chromium plated cylinder bores, the inner cylindrical walls are typically made porous in the range of 10%–50% by a variety of methods, such as reverse current etching, as disclosed, for example, in U.S. Pat. No. 2,314,604, No. 2,412,698, No. 2,430,750, No. 2,433,457, No. 2,620,296, chemical etching, or various mechanical methods. These methods provide virtually mirror smooth plateau bearing surfaces surrounding the pores or crevices formed thereby.

Due to variations inherent in any manufacturing process, the piston rings of the pistons which reciprocate in the cylinder bores and the inner cylindrical bearing surfaces of the bores often do not match, which is detrimental to obtaining a positive seal to high pressure gases or liquids. To cause the piston rings to lap in to fit the cylinder bore surface, it has been known in the past to provide an abrasive finish to the entire cylindrical wall of the cylinder liner by a dry abrasive blasting method, such as is disclosed in U.S. Pat. No. 3,063,763. As described in the aforementioned patent the break-in surface typically has a depth of porosity induced by blasting of from 7 to 20 microinches depending on the size of abrasive used in the blast. In this prior process, the representative coating is formed by blasting the surface of a typical 9" diameter by 22" cylinder with around 100 pounds of abrasive within about a minute. When using that amount of abrasive, each part of the surface is impacted by a large number of particles, resulting in a thoroughly roughened surface having sharp, closely spaced projections.

Disadvantages of the known cylinder liner break-in finish includes a relatively long "break-in" period during which the piston rings lap in to fit the cylinder bore, excessive ring wear and piston ring groove wear during the prolonged break-in period and an undesirably high oil consumption during this break-in period, as well as during subsequent operation of the engine as a result of increased residual porosity.

It is, therefore, an object of the invention to provide a finish to the inner cylindrical surface of a cylinder liner which results in a comparatively short break-in period relative to the known finishes, minimal ring and ring groove wear, and which will result in reduced lubricating oil consumption while still maintaining outstanding wear resistance.

SUMMARY OF THE INVENTION

In accordance with the present invention, after applying a first finish and base porosity to the inner surface of the cylinder, the break-in surface is applied with substantially dispersed pits and projections, (in contrast to the closely spaced projections which had been the standard industry practice for at least 25 years). In the present invention this desired wide spacing is best achieved by reducing the blast site by 100 fold over that previously used. As mentioned above, in the prior art, and in normal industry practice, a 22 inch by 9 inch diameter cylinder wall would be blasted within the order of 100 pounds of abrasive in a one minute period, amounting to the application of around 0.15 to 0.2 pounds of abrasive per square inch of surface. In the present invention, the blast rate is between 0.0005 and 0.005 pounds per square inch, and may be preferably in the order of 0.001 to 0.002 pounds per square inch. At this application rate,- the resultant pores with abrasive projections are sparcely scattered throughout the surface being roughened. For example, when using 150 mesh grit, the pores generated are about 0.00015 inches in diameter and the resultant uplifted metal is much smaller yet. Each of these pores with uplifted projections are spaced about 0.004 inches apart or roughly 26.6 pore diameters apart.

The resulting surface roughness is slightly visible by eye if viewed under the right light, (particular if applied in a pattern as described below), but nevertheless is so slight that the increase in surface porosity, as measured by a profilometer, relative to the base porosity is nearly immeasurable. For instance in a typical case, the base porosity of a cylinder lining after etching and honing might be in the order of 20 microinches rms. The rms porosity after application of the break-in coating of the present invention will not be statistically different.

Surprisingly where it had previously been thought that the break-in coating required a distinctly measurable roughness, and high application rate to be effective, I have discovered that the barely perceptible break-in surface of the present invention is effective to conform the cylinder and piston to each other during break-in. This invention has the advantage that the residual roughness after break-in is only that which is controllably applied as the base porosity, so that oil consumption is dramatically improved.

In a preferred embodiment of the present invention the foregoing break-in coating is applied in a distinct pattern in which the abraded portions of the cylinder wall cover from 10% to 80% of the surface, and preferably between 30% to 50%. In this improvement the pattern may be either regular, geometric or random, but arranged so that as the piston reciprocates, each arcuate element of the piston perimeter passes through roughly equal amounts of abraded and non-abraded surface.

As an example of the present invention, the cylinder liner, having an electro-deposited chromium finish, is honed to a smooth finish of proper dimensional tolerance. Porosity is then induced by any of the conventional reverse current methods, crack inducing methods or mechanical methods, for example, by methods such as those described in the above-mentioned U.S. patents. Porosity can be controlled within the range of 10% to 50%, with various degrees of hole diameters and depths, or crack structures and densities. Some methods produce very uniformly controlled pore densities, diameters and depths. The cylinder liner is then fine-honed to create smooth plateau bearing surfaces resulting in a first finish, or "base porosity" for the cylinder liner.

The second "break-in" surface is then applied either over all or in a pattern such that each peripheral element of the piston ring will contact the break-in (abraded) surface and non-abraded surface during its travel in the cylinder bore in roughly equal proportions. The break-in surface is formed by applying a matt of fine abrasive media, for example, dry aluminum oxide. Preferably, the break-in surface will increase the base porosity of the cylinder liner by only about 1%–3% once it has worn away during the break-in period.

In accordance with a preferred embodiment, the break-in surface is applied in a spiral pattern, similar to a "barbershop pole", on the inner surface area of the cylinder liner. It should be understood that the invention is not limited to a spiral pattern, however, and patterns of circular, square, geometric and non-geometric shapes, even random shapes of various sizes and densities will be satisfactory. It is only necessary that the break-in surface be provided in such a manner that every radial position of a piston ring reciprocating in the cylinder bore contacts both the smooth plateau surfaces of base porosity areas and the break-in surface areas of the cylinder liner during the course of a stroke, thereby providing intermittent contact of the piston ring on the break-in surface. This partial contact reduces the load bearing area of the piston ring and thus increases the surface loading, thus providing faster lapping-in of the piston rings.

BRIEF DESCRIPTION OF THE DRAWINGS

For a better understanding of the present invention, the scope of which will be pointed out in the appended claims, reference is made to the following detailed description of an illustrative example thereof, taken in conjunction with the accompanying drawing, in which

DESCRIPTION OF EXEMPLARY EMBODIMENT

Figure 1:
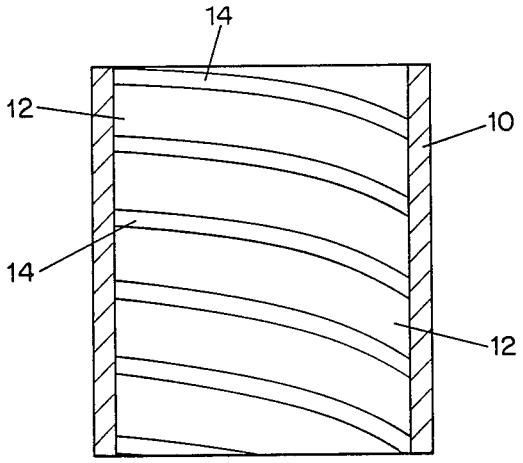
FIG. 1 represents a longitudinal view in section of a part of a cylinder for a reciprocating piston engine having an inner cylindrical surface area finished in accordance with the present invention.
Figure 2:
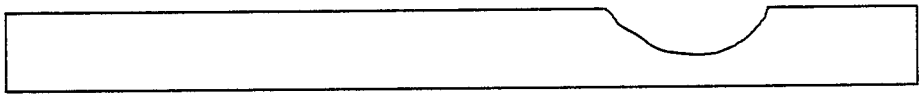
FIG. 2 is a magnified sectional view of a cylinder bore surface having a base porosity, before a break-in finish has been applied.
Figure 3:
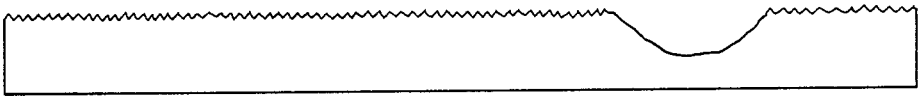
FIG. 3 shows the cylinder bore surface of FIG. 2 after a break-in finish has been applied according to the industry standard method.
Figure 4:
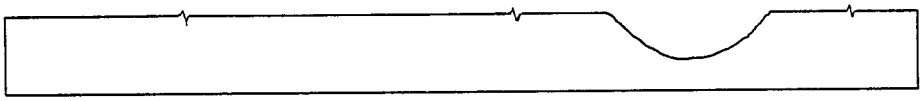
FIG. 4 shows the cylinder bore surface of FIG. 2 after the break-in finish has been applied according to the present invention.

Referring to FIG. 1, there is illustrated a longitudinal view in section of part of a cylinder for a reciprocating-piston engine, the surface of which has been finished in accordance with an exemplary embodiment of the present invention.

The cylinder 10 may be made of cast iron, steel, or other suitable material, and in this embodiment has been provided with an electroplated chromium finish by a manner known per se. The cylinder is then honed to finish size tolerances, and a surface porosity is induced by any of the known methods for doing so, e.g., by reverse current etch methods or mechanical methods. After including the base porosity in the range of 10%–50%, depending on the specific application and the amount of lubricating oil retention required, the surface is often fine-honed to provide smooth plateaus, or land surfaces, around the pores. Pore depth may vary from a superficial one one-hundred-thousandths of an inch deep to three-thousandths of an inch deep, depending upon the method selected for imparting the base porosity. The resulting finish is the "base porosity" of the cylinder liner.

To achieve the rapid and efficient break-in period desired of the present invention, a second "break-in" surface is formed, preferably this break-in surface does not cover the entire surface area of the cylinder liner, but only about 10%–80%, preferably in a range of about 30%–50%, of the surface area.

In a preferred example herein described, the break-in surface is formed by applying a matt of abrasive media, for example, aluminum oxide, of 60–150 grit size. The break-in surface should be sparse, and may typically form a spiral pattern, similar to a barbershop pole. For in a 22 inch by 9 inch diameter cylinder the break-in surface is a single spiral 14 of about 1"–1-½" wide, leaving a spiral 12 of about 1-½"–2-½" wide of the first base porosity surface (i.e., cylinder liner to which the break-in surface has not been applied) between the spirals 14 of the break-in surface. If applied by an impeller, the spiral pattern in the break-in surface is created by an appropriate mask. Alternatively the break-in surface can be applied by a nozzle which blasts a jet of air laden with abrasive on a small portion of the surface. By rotating the jet in a spiral pattern relative to the liner, a spiral break-in surface is generated. In either event, the abrasive is applied at a low rate to generate substantially dispersed pits and projections which characterize the break-in surface of the present invention. Typically the blast rate is in the order of one pound of abrasive for a cylinder of 22 inch by 9 inch diameter applied in a time of about one minute.

The break-in surface is provided on the cylinder liner in such a manner that every radial position of a piston ring reciprocating in the cylinder bore contacts both the base porosity areas 12 and the break-in surface areas 14 of the cylinder liner during the course of its stroke in the cylinder, thereby providing intermittent contact of all radial locations of the piston ring on both base porosity 14 and break-in surface 12 areas of the cylinder liner. In the illustrated example, about 120° of the periphery of the piston ring contacts the second finish, the remaining 240° of the periphery contacting the base porosity surface at any given axial location.

I believe that the intermittent contact of the piston ring on the two different surfaces reduces the load bearing area of the cylinder liner, and thus increases the surface load in the break-in surface area, thus providing faster lapping in of the piston rings. Substantially all of the break-in surface eventually wears down during the break-in period, and imparts only a slight additional porosity to the base priority of the cylinder liner preferably of only about 1%–3%.

It should be understood that the present invention is not limited to the application of the second finish in the spiral pattern illustrated, and that variations and modifications may be made without departing from the inventive concepts disclosed herein. For example, patterns of circles, squares, geometric or non-geometric shapes, even random shapes of various sizes and densities may suffice. All such variations and modifications are intended to fall within the scope of the appended claims.

I claim:

1. In a finish for an inner surface area of a cylinder liner of a reciprocating piston engine, wherein the entire inner surface area is honed to provide a finish of first predetermined porosity thereby to define a base porosity for said entire inner surface, and wherein a second, break-in surface is formed by further treating said inner surface to form a second break-in surface, the improvement wherein said break-in surface is characterized by substantially dispersed pits and projections resulting from abrading said honed surface of said first predetermined porosity by the impact of abrasive particles, the amount of roughness attributed to the break-in surface being sufficient to facilitate break-in of the cylinder and piston to each other but not significantly greater than the roughness of the cylinder surface before abrasion thereof with said abrasive particle.

2. The improvement according to claim 1 wherein the break-in roughness, after the break-in period, imparts an increase in porosity to the honed porous cylinder surface of less than 3%.

3. The finish according to claim 1, wherein the cylinder liner includes a chromium liner on its inner surface.

4. The improvement according to claim 1, wherein the break-in surface is applied in a pattern covering from 10% to 80% of the cylinder wall.

5. The finish according to claim 4, wherein the pattern of said break-in surface is spiral.

6. The finish according to claim 5, wherein said pattern is a single spiral.

7. In a finish for an inner surface area of a cylinder liner of a reciprocating piston engine, wherein the entire inner surface area is honed to provide a finish of first predetermined porosity thereby to define a base porosity for said entire inner surface, and wherein a second, break-in surface is formed by further treating said inner surface to form a second break-in surface, the improvement wherein said break-in surface is generated by blasting said honed porous surface having 20% to 50% porosity with between 0.0005 and 0.005 pounds of abrasive of 60 to 150 mesh per square inch of cylinder surface.

8. The improvement according to claim 7 wherein the break-in roughness, after the break-in period, imparts an increase in porosity to the honed porous cylinder surface of less than 3%.

9. The improvement according to claim 7, wherein the break-in surface is applied in a pattern covering from 10% to 80% of the cylinder wall.

10. The finish according to claim 7, wherein the cylinder liner includes a chromium liner on its inner surface.

11. The improvement according to claim 7, wherein the break-in roughness, after the break-in period, imparts an increase in porosity to the honed porous cylinder surface of less than 3%.

12. The finish according to claim 1, wherein the cylinder liner includes a chromium liner on its inner surface.

13. The improvement according to claim 7, wherein the break-in surface is applied in a pattern covering from 10% to 80% of the cylinder wall.

14. The finish according to claim 13, wherein the pattern of said break-in surface is spiral.

15. The finish according to claim 14, wherein said pattern is a single spiral.

* * * * *